US007002351B1

(12) United States Patent
McQueeney et al.

(10) Patent No.: US 7,002,351 B1
(45) Date of Patent: Feb. 21, 2006

(54) VARIABLE COMPENSATION CIRCUIT FOR CAPACITIVE ADAPTERS

(75) Inventors: Kenneth A. McQueeney, Los Gatos, CA (US); John P. Walton, Santa Cruz, CA (US); Lee M. Snorteland, San Jose, CA (US)

(73) Assignee: Snap-On Incorporated, Pleasant Prairie, WI (US)

( * ) Notice: Subject to any disclaimer, the term of this patent is extended or adjusted under 35 U.S.C. 154(b) by 51 days.

(21) Appl. No.: 10/787,261

(22) Filed: Feb. 27, 2004

(51) Int. Cl.
*F02P 17/00* (2006.01)

(52) U.S. Cl. ..... 324/402; 324/380

(58) Field of Classification Search ..... 324/402, 324/378, 380, 393, 399
See application file for complete search history.

(56) References Cited

U.S. PATENT DOCUMENTS 4,399,407 A 8/1983 Kling et al. ..... 324/379
4,833,400 A * 5/1989 Boutigny ..... 324/126
5,155,437 A * 10/1992 Frus ..... 324/399
5,293,308 A * 3/1994 Boys et al. ..... 363/37
5,444,376 A * 8/1995 Dittmann et al. ..... 324/402
5,461,316 A * 10/1995 Maruyama et al. ..... 324/402
5,677,632 A 10/1997 Meeker ..... 324/380
6,396,278 B1 5/2002 Makhija ..... 324/402
2003/0098698 A1 * 5/2003 Bengtsson ..... 324/644

* cited by examiner

*Primary Examiner*—Anjan Deb
(74) *Attorney, Agent, or Firm*—McDermott Will & Emery LLP

(57) ABSTRACT

A variable compensation circuit for capacitive adapters is provided and includes an input connector for receiving a signal output from a capacitive adapter positioned within an electric near field emitted from a component of an engine ignition system, an output connector for outputting a signal output from the variable compensation circuit, a capacitive divider circuit portion disposed in series between the input and output connectors, the capacitive divider circuit portion comprising at least one of a variable capacitor and a plurality of fixed capacitors. The variable compensation circuit also includes a switching element configured to enable at least one of a selection and de-selection of the plurality of fixed capacitors and adjustment of a variable capacitor to provide one of a plurality of selected capacitance reactance ratios.

20 Claims, 7 Drawing Sheets

VARIABLE COMPENSATION CIRCUIT FOR CAPACITIVE ADAPTERS

TECHNICAL FIELD

The disclosure relates to diagnostic equipment and methods used to analyze the performance of internal combustion engine ignition systems, inclusive of coil-on plug or coil-over plug ignitions. The disclosure has particular applicability to diagnostic equipment and methods utilizing capacitive adapters to detect and output secondary ignition waveforms to a display for technician evaluation.

BACKGROUND DISCUSSION

Capacitive signal detectors are conventionally used to assess the performance of ignition systems, such as coil-on-plug (COP) systems utilizing one coil per cylinder or a direct ignition system (DIS) or double ended coil-on plug (DE-COP) utilizing one coil per cylinder pair. Capacitive signal detectors can output signals indicative of spark plug firing voltage and duration, which help technicians determine if any component in the ignition system is malfunctioning. Such conventional systems may be found in, for example, U.S. Pat. No. 4,399,407 to Kling et al., U.S. Pat. No. 5,461,316 to Maruyama et al., U.S. Pat. No. 5,677,632 to Meeker, and U.S. Pat. No. 6,396,278 to Makhija.

Almost all capacity adapters, whether for sampling coils or ignition wires, employ a capacity divider. As shown in FIG. 1(*a*), one side of the capacity divider comprises a very small capacitor C1, one side of which is placed in the vicinity of the high voltage electric field present during the ignition system spark cycle. The other side of the capacity divider is connected to the top of a much larger capacitor C2 whose bottom side is connected to ground. The ratio of the values of these two capacitors, the high voltage division ratio, is typically between about 5000:1 and 10,000:1, which corresponds to a voltage across the larger capacitor of between about 10V and 5V for a 50 kV firing line. Under ideal conditions, the ratio is independent of frequency so that the waveform (e.g., the firing line, spark line, or spark duration) is not distorted.

FIG. 1(*b*) shows an equivalent circuit for the equipment configuration represented in FIG. 1(*a*). Voltage $E_1$ represents the voltage at the sensor 10 proximally coupled to the COP ignition 30 and voltage E0 represents the output voltage. The ratio $E_0/E_1$ is equal to the ratio $(I*R_2)/(I*(R_1+R_2)$ or, simplifying, $R_2/(R_1+R_2)$. When $R_1$ is much greater than $R_2$, the ratio $E_0/E_1$ further simplifies to $R_2/R_1$. By superposition, when $X_{C1}$ is substituted for $R_1$ and $X_{C2}$ for $R_2$, the ratio $E_0/E_1$ further simplifies to $X_{C2}/X_{C1}$. This is a compensated, or frequency insensitive, divider since $E_0/E_1$ is the same for resistances (R's) and capacitive reactances ($X_C$'s).

Accordingly, conventional adapters are dedicated or designed, developed, and fabricated for specific combinations of a COPs and a display device or lab scope. In other words, these specifically configured adapters are balanced for use with a particular combination of coil and equipment. However, if any component in the combination is disturbed by substituting a non-dedicated component for a dedicated component in a balanced system (e.g., a different lab scope is used), the system is not longer compensated or independent of frequency. Accordingly, the resulting waveforms conveying data on the firing line, spark line, or spark duration are undesirably distorted. An example of this is shown in FIG. 1(*c*), wherein the spark kV or spark line voltage decreases notably with time prior to the return to zero instead of remaining reasonably or substantially constant.

For example, a resistance value $R_2$ for a first engine analyzer or lab scope may be 1 MΩ, whereas a resistance value $R_2$ for a second engine analyzer or lab scope may be 10 MΩ. Thus, a sensor system balanced for use with the first scope will not be balanced for use with the second scope.

Therefore, there is a need for a compensated capacity divider which may be adjusted to be frequency independent or insensitive for many different combinations of capacitive sensors and diagnostic equipment or lab scopes.

SUMMARY OF THE DISCLOSURE

The present disclosure illustrates concepts directed to the structure and use of a variable compensation circuit between a capacitive adapter and a display device or lab scope to provide a properly compensated, substantially frequency insensitive, sensing system for a plurality of combinations of sensors and engine analyzers.

In one aspect, there is provided a variable compensation circuit for capacitive adapters comprising an input connector for receiving a signal output from a capacitive adapter positioned within an electric near field emitted from a component of an engine ignition system, an output connector for outputting a signal output from the variable compensation circuit, a capacitive divider circuit portion disposed in series between the input and output connectors, the capacitive divider circuit portion comprising at least one of a variable capacitor and a plurality of fixed capacitors. The variable compensation circuit also includes a switching element configured to enable selection and/or de-selection of any one of or any combination of the plurality of fixed capacitors and/or adjustment of a variable capacitor to provide one of a plurality of selected capacitance reactance ratios.

In another aspect, there is provided a signal compensation method for engine ignition system diagnostics testing comprising the steps of establishing a circuit between a capacitive sensor positioned within an electric near field emitted from a component of an engine ignition system, a variable compensation circuit, and a diagnostic testing device, inputting a signal from the capacitive sensor to the variable compensation circuit, monitoring the signal output from the variable compensation circuit using the diagnostic testing device, and adjusting a capacitance value of at least one capacitor in the variable compensation circuit to provide one of a plurality of selected capacitance reactance ratios. In this method, the variable compensation circuit itself comprises a capacitive divider circuit portion including a plurality of capacitors and a switching element configured to enable at least one of a selection, de-selection, and adjustment of the plurality of capacitors. In another aspect of this method, the adjusting step also includes adjusting a return to zero portion of a displayed waveform output from the variable compensation circuit.

Additional advantages will become readily apparent to those skilled in this art from the following detailed description, wherein only preferred examples of the present concepts are shown and described. As will be realized, the disclosed concepts are capable of other and different embodiments, and its several details are capable of modifications in various obvious respects, all without departing from the spirit thereof. Accordingly, the drawings and description are to be regarded as illustrative in nature, and not as restrictive.

BRIEF DESCRIPTION OF THE DRAWINGS

The foregoing and other features, aspects and advantages of the present concepts are described in the following detailed description which examples are supplemented by the accompanying drawings, in which like reference numerals indicate like elements and in which:

FIG. 1(*b*) shows an equivalent circuit for the combination shown in FIG. 1(*a*);

FIG. 1(*c*) shows an example of an conventional combination of coil-on-plug ignition, coil-on-plug sensor, and lab scope, wherein a non-dedicated component is substituted for a dedicated component.

DETAILED DESCRIPTION

Embodiments described herein or otherwise in accord with the concepts presented herein may include or be utilized with any appropriate voltage source, such as a battery, an alternator and the like, providing any appropriate voltage such as, but not limited to, about 9 Volts, about 12 Volts, about 42 Volts and the like.

Coil-on-plug (COP) ignitions generally comprise a spark coil integrally mounted on spark plug, which protrudes into and is mounted in an engine cylinder and terminates in spark gap. The spark coil conducts transformed, high voltage direct current to the spark plug using internal connections. The coil receives low voltage direct current via a wiring harness that has a distal end coupled to a primary coil of the coil and a proximal end coupled to a battery.

Figure 2A:
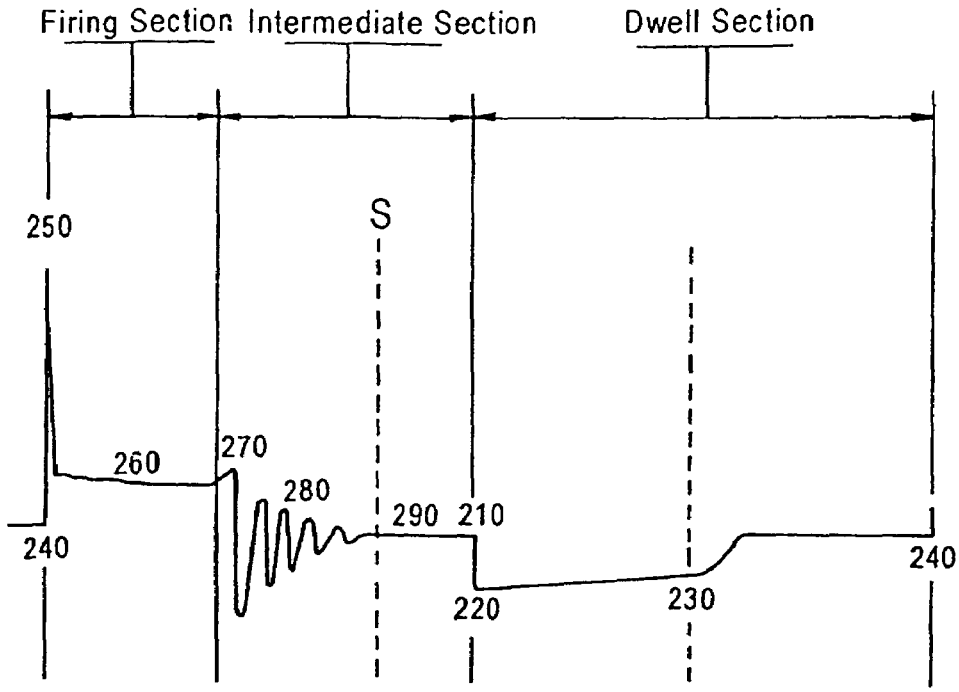
FIGS. 2(*a*)–(*b*) respectively depict a typical primary ignition waveform and secondary ignition waveform displayed as a function of time.
Figure 2B:
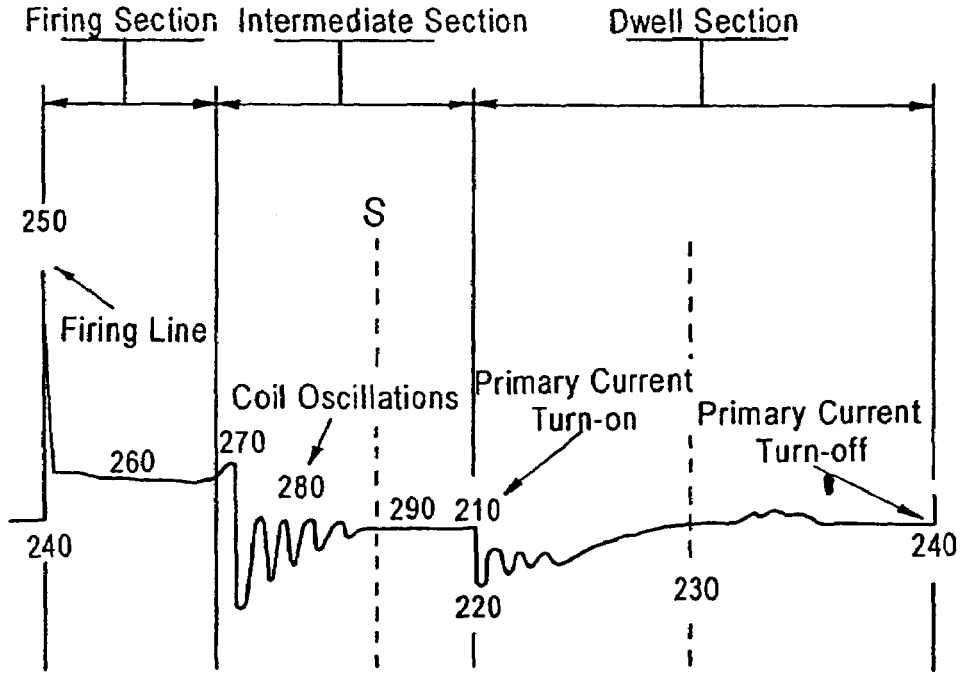

FIGS. 2*a* and 2*b* illustrate, respectively, a typical primary ignition waveform and secondary ignition waveform as a function of time for a conventional engine ignition such as, but in no way limited to, a COP ignition. The waveforms have three basic sections labeled Firing Section, Intermediate Section, and Dwell Section.

Common reference numerals are used in FIGS. 2*a* and 2*b* to represent common events occurring in both the primary and secondary waveforms. At the start S of the waveform, no current flows in the primary ignition circuit. Battery or charging system voltage available at this point generally ranges from approximately 12–15 volts, but is typically between about 12–14 volts. At 210, the primary switching device turns on the primary current to start the "dwell" or "charge" section. At 220, current flows through the primary circuit, establishing a magnetic field in the ignition coil windings. A rise in voltage occurs along 230 indicating that coil saturation is occurring and, on ignition systems that use coil saturation to control coil current, a current hump or voltage ripple appears at this time. The part of the waveform representing primary circuit on-time is between points 210 and 240. Thus, the portion of the signal between points 210 and 240 represents the dwell period or "on-time" of the ignition coil primary current.

The primary switching device terminates primary current flow at 240, suddenly causing the magnetic field to collapse, thereby inducing a high voltage in the primary winding by self-induction. An even higher voltage is induced, by mutual induction, into the secondary winding, because of a typical 1:50 to 1:100 primary to secondary turns ratio. The secondary voltage is delivered to the spark plug gap, and the spark plug gap is ionized and current arcs across the electrodes to produce a spark 250 (i.e., the "firing line") to initiate combustion and the spark continues for a period of time called the "spark duration" or "burn time" 260.

The firing line 250, measured in kilovolts, represents the amount of voltage required to start a spark across the spark plug gap, and is generally between about 6–12 kV. The burn time 260 represents the duration of the spark event, is generally between about 1–3 milliseconds and is inversely related to the firing kV. If the firing kV increases, burn time decreases and vice versa. Over the burn time 260, the discharge voltage across the air gap between spark plug electrodes decreases until the coil energy cannot sustain the spark across the electrodes (see e.g., 270). At 280, an oscillating or "ringing" voltage results from the discharge of the coil and continues until, at 290, the coil energy is dissipated and there is no current flow in the primary circuit.

To detect the above events, the capacitive adapter or sensor 10 is placed within an electric near field of a component of the engine ignition system, such as adjacent a coil on plug ignition housing or around or adjacent a spark plug wire, by an appropriate fixation device or placement technique. The detected signal is output via an output lead, which may comprise any physical means by which a signal may be output from the capacitive adapter 10 such as, but not limited to, co-axial cable, cables, or wires. Such means for outputting a signal are passive and require no external power, thus complementing the disclosed capacitive adapter by providing a completely passive system advantageously requiring no external power. However, other means for outputting a signal are also encompassed by the present concepts including, but not limited to, acoustic (e.g., radio frequency (RF)) or light-based (e.g., light infrared (IR)) transmitters or any other medium (i.e., carrier waves) by which information may be transmitted. The capacitive sensor or adapter 10 may comprise any type of conventional capacitive adapter.

Figure 3:
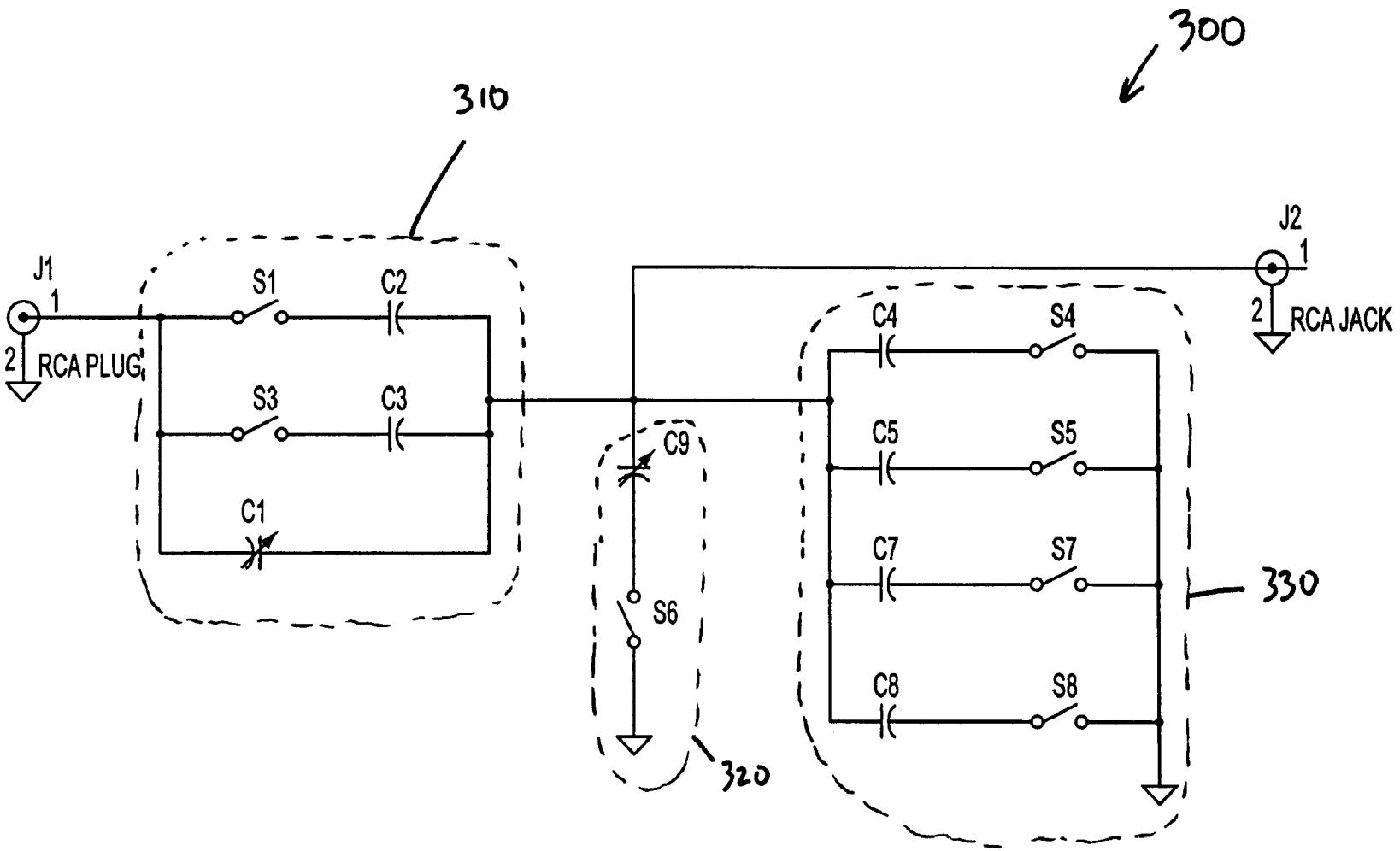
FIG. 3 shows an example of a variable compensation circuit in accord with the present concepts.

The input of variable compensation circuit 300 shown in FIG. 3 is connected, via input terminal J1, to any conventional capacitive adapter or capacity coupled adapter such as, but not limited to, Snap-On® COP-1 through COP-9 adapters (EETM306A03 through EETM306A13), Vantage® kV Module CIC adapters, Vantage® kV clips, Modis® kV clips, Snap-On® spring clip, Snap-On® universal clip, Snap-On® magnetic mount adapter, DIS tester HV wire clip, Bosch® HV wire clip, Snap-On® flags, or Snap-On® hybrid adapters. Variable compensation circuit 300 output J2 is connected to any conventional engine analyzer, lab scope, ignition scope, or display, such as but not limited to a Snap-On® Vantage®/KV Module (EETM306A) or Snap-On® MODIS® module, using an appropriately configured signal output device or cable (e.g., a Snap-On® cable EETM306A01 or 6-03422A, Rev. D, for the above diagnostic devices). The MODIS® module provided by way of example herein generally includes any lab scope or ignition scope with a 10 MΩ DC input resistance and a 3 db bandwidth or 3 MHz minimum.

Figure 4:
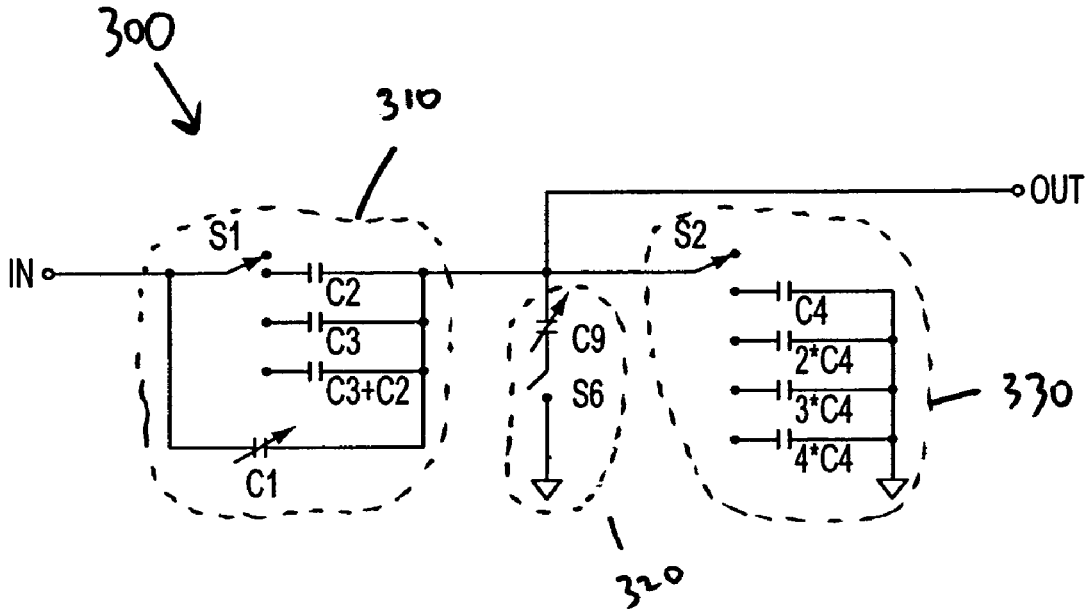
FIG. 4 shows another example of a variable compensation circuit in accord with the present concepts.

Once the variable compensation circuit 300 is electrically connected between the capacitive adapter or sensor 10 and a selected diagnostic testing device, such as a lab scope or engine analyzer (e.g., a Snap-On® Vantage/KV Module, Snap-On® MODIS™, or conventional lab scope), an output of the variable compensation circuit may be adjusted, such as represented in the example of FIGS. 3 and 4, by selection or de-selection of fixed capacitors (e.g., C2, C3, C4, C6, C7, and C8) and/or by adjustment of variable capacitors (e.g., C1 and/or C9). The selection or de-selection (isolation) of fixed capacitors C2–C8 in the example of FIG. 3 is accomplished by SPST toggle switches provided in series to individual fixed capacitors, although any other conventional switch, relay, switch, rotary switch, electronic switching matrix, or multiplexor may also be substituted therefor. It is generally desired to select switches with a low capacity, such as provided in the examples herein, so as to minimize influence of the switch on the circuit.

Although a single switch is provided in series to an individual fixed capacitor in the example of FIG. 3, switches may alternatively or additionally be placed and/or configured to permit selection or de-selection of banks (i.e., a plurality) of capacitors. For example, as shown in FIG. 4, rotary switch S1 is configured to select any of C2, C3, and a capacitor having the combined capacitance of C2+C3. In one aspect, rotary switch S1 may be a 1-pole electroswitch having 2–12 positions and set for 4 positions and may comprise, for example, a D2D0112N switch or other mil-spec D1 or D2 series, non-shorting ceramic rotary switch. Likewise, a similar rotary switch S2 is configured to select one of a plurality of capacitances represented by C4 and multiples thereof (e.g., C4, 2*C4, 3*C4, 4*C4). Thus, as appreciated by those of ordinary skill in the circuit design art, the exemplary circuit configurations presented in FIGS. 3–4 may be reconfigured in innumerable ways to achieve the same effect or similar ends. In accord with the present concepts, any number of capacitors or capacitive elements or combinations of such capacitors or capacitive elements may be provided in parallel and/or in series may be employed to adjust or tune the capacitance ratio to a selected one of a plurality of values.

In one aspect, the capacitance ratio of variable compensation circuit 300 may be adjusted by selection, de-selection, and/or adjustment of the available capacitors or groupings of capacitors in the portion of the circuit in series to the output (i.e., circuit portion 310), to provide a firing line of about 10 kV (e.g., 7 kV to 15 kV). In the circuit shown in the Example of FIGS. 3–4, the gross level of the firing line may be adjusted by selecting a desired setting (on/off) for each of the fixed capacitors (e.g., C2 "on", C3 "off") to provide any desired combination of settings thereof and/or variation of the variable capacitor C1. In the illustrated example, the first shunt 320 and the second shunt 330 may then be further adjusted to provide a satisfactory (i.e., minimal distortion) return to zero at the end of burntime. Optionally, the functionality of adjusting the capacitances and capacitive reactances to provide a satisfactory return to zero at the end of burntime may be manifested in alternative circuit configurations (i.e., other than that depicted in the examples of FIGS. 3–4) in a manner known to those skilled in the art of automotive diagnostic circuit design.

In one aspect, a signal compensation method for engine ignition system diagnostics testing in accord with the present concepts comprises the steps of establishing a circuit between a capacitive sensor positioned within an electric near field emitted from a component of an engine ignition system, a variable compensation circuit, and a diagnostic testing device, inputting a signal from the capacitive sensor to the variable compensation circuit, monitoring the signal output from the variable compensation circuit using the diagnostic testing device, and adjusting a capacitance value of at least one capacitor in the variable compensation circuit to provide one of a plurality of selected capacitance reactance ratios, wherein the variable compensation circuit comprises a capacitive divider circuit portion including a plurality of capacitors and a switching element configured to enable at least one of a selection, de-selection, and adjustment of the plurality of capacitors.

To ensure that the variable compensation circuit 300 is not being adjusted to a potentially degraded cylinder, the circuit 300 may be set by initially reviewing the indicated peak firing voltages of a plurality of COPs (e.g., 2 or more) and adjusting the circuit based on the highest indicated peak firing voltage. In another aspect, a guide may be prepared compiling desired circuit configurations for selected combinations of sensors and diagnostic devices. This firing line value (10 kV) is completely arbitrary and is selected solely for the reason that this value is typically encountered by technicians and diagnosticians evaluating properly operating ignition signal traces and will accordingly mitigate confusion which might arise over other values, such as 5 kV, 20 kV, or 40 kV, which are equally viable in accord with the concepts expressed herein. A firing line of at least 5 kV is desirable.

Figure 5:
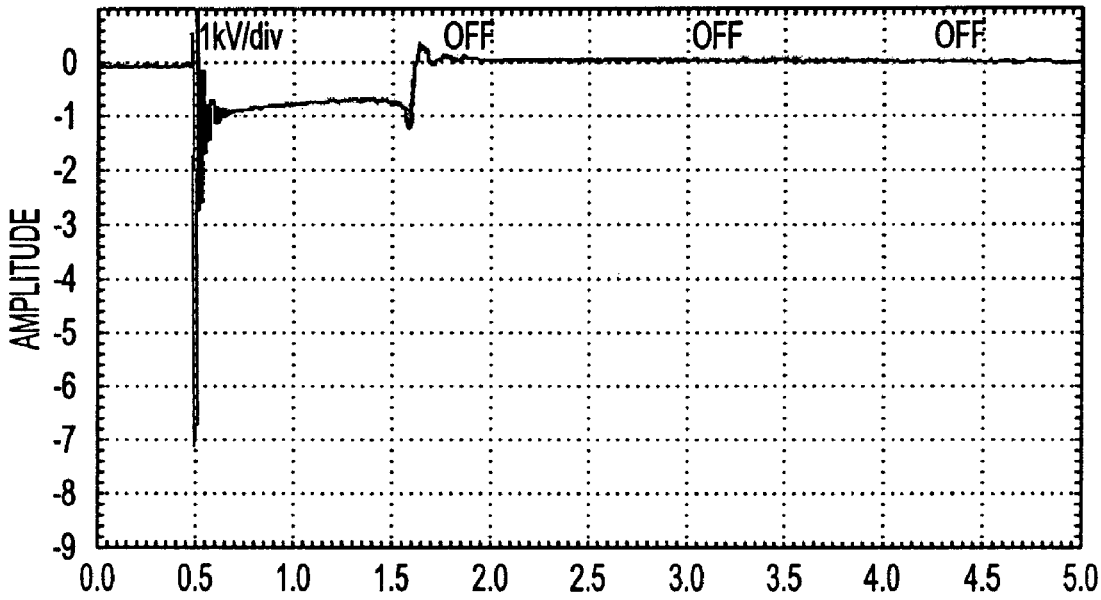
FIG. 5 shows an example of the disclosed variable compensation circuit used with a first diagnostic testing device.
Figure 6:
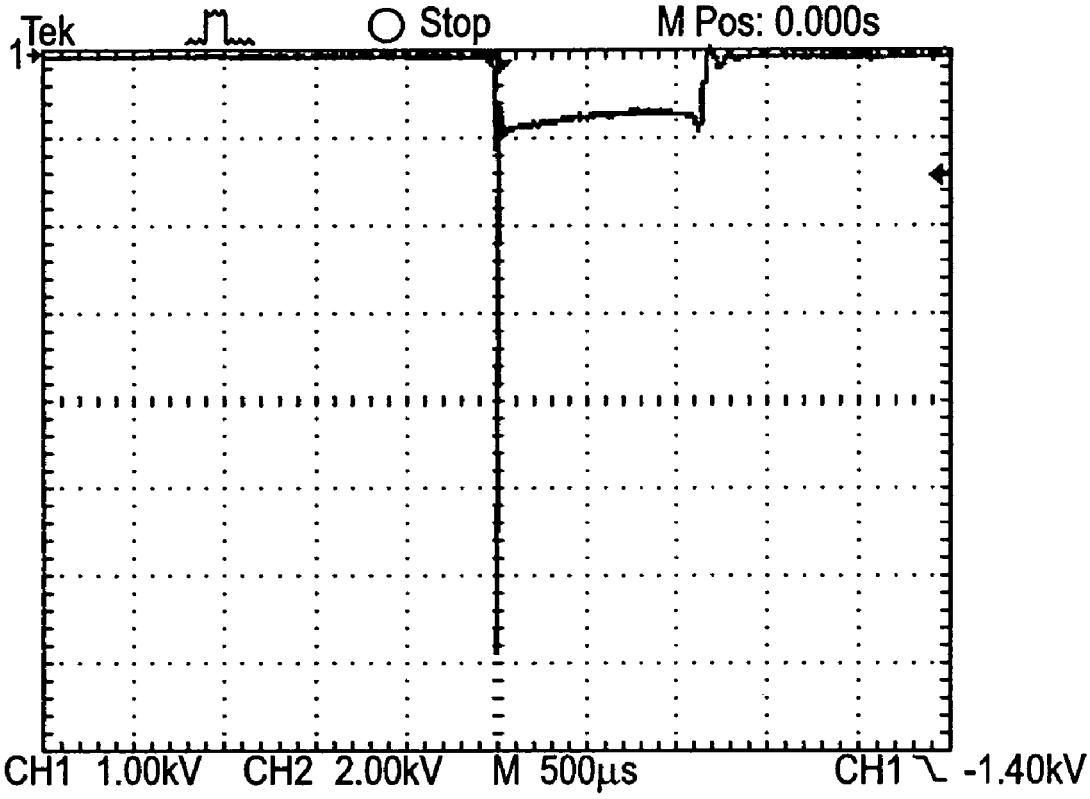
FIG. 6 shows another example of the disclosed variable compensation circuit used with a second diagnostic testing device.

Once the firing line is set to a satisfactory level, it is desired to modify the capacitance to also set the voltage observed at the end of the burntime to zero (i.e., no residual charge left in the capacitors). Following the initial adjustment of the variable compensation circuit 300, the first shunt 320 and/or the second shunt 330 are adjusted to set the voltage observed at the end of the burntime 240 (insert into figure corresponding numbers from FIGS. 2*a*–*b*) to zero, as shown in FIGS. 5–6. Once this adjustment is completed, the indicated spark event will closely approximate the actual firing event and the resulting waveform can be confidently used to diagnose the firing line (power kV), spark line (spark kV), spark duration (burntime) and other events of interest.

The above-noted adjusting step may comprise adjustment of a capacitance value of a capacitive divider circuit portion 310 disposed in series between input connector J1 and output connector J2 of the variable compensation circuit 300, particularly by selection or de-selection of one or more fixed capacitors (e.g., C2, C3) and/or adjustment of the variable capacitor C1. The above-noted adjusting step may also comprise, alternatively or in combination, adjustment of the capacitance value of the first shunt 320 and/or the second shunt 330. In the illustrated example, the adjustments to the shunts could comprise, for example, adjusting the variable capacitor C1, selecting or deselecting any of the fixed capacitors (C2, C3, C4, C5, C7, C8), or disconnecting the first shunt 320 or the second shunt 330 from the circuit by an appropriate switch.

As noted above, the signal compensation method adjusting step further comprises adjusting a capacitance value of the capacitive divider circuit portion 310 and/or the first shunt 320 and/or the second shunt 330 to adjust a firing line of a displayed waveform output from the variable compensation circuit. The method also includes adjusting a capacitance value of the capacitive divider circuit portion 310 and/or the first shunt 320 and/or the second shunt 330 to set the best return of voltage to zero following the end of burntime of a displayed waveform output from the variable compensation circuit 300. In other words, the capacity in the circuit is increased or reduced, in the manner previously indicated, to minimize the residual decay (e.g., RC exponential decay) of shunt capacitors which are positively or negatively charged at the zero crossing after the end of burntime. In this manner, the displayed waveform will closely approximate the actual firing event.

Figure 1A:
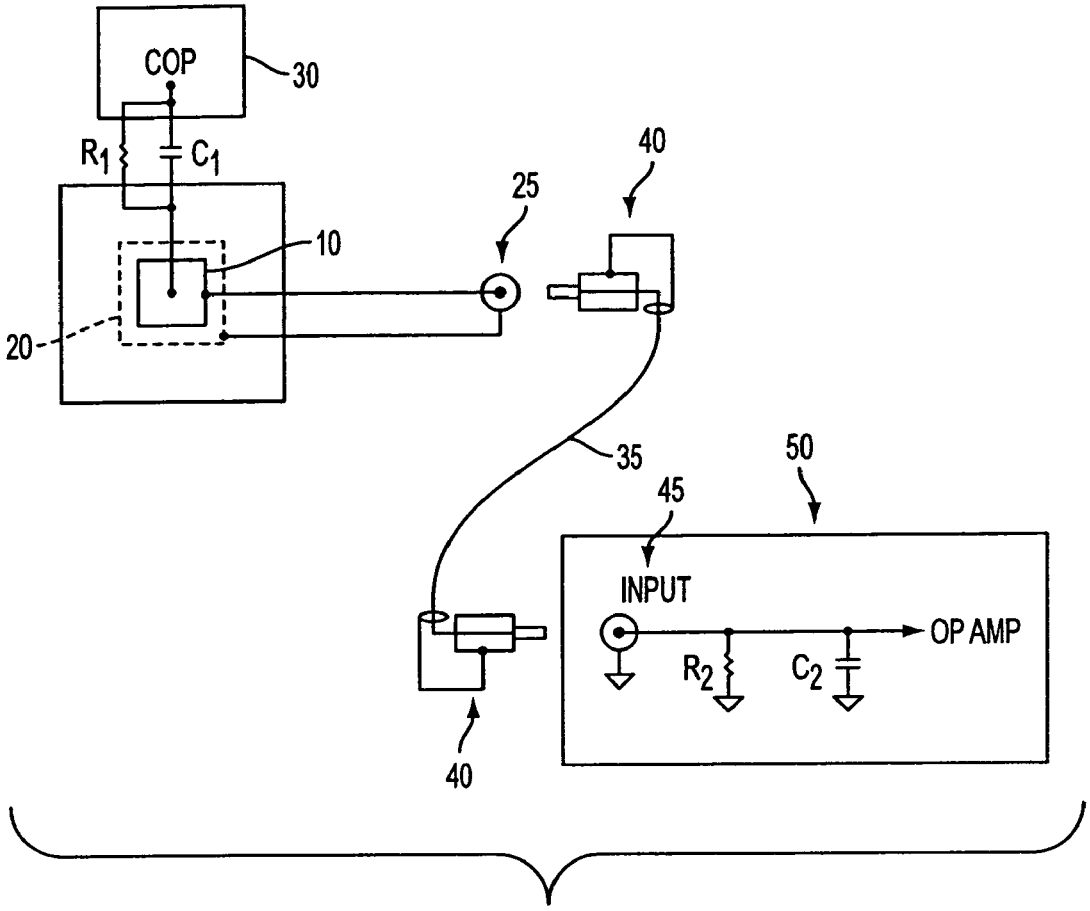
FIG. 1(*a*) shows an example of a conventional combination of coil-on-plug ignition, coil-on-plug sensor, and lab scope.
Figure 1B:
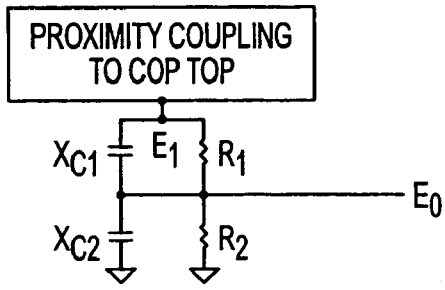
Figure 1C:
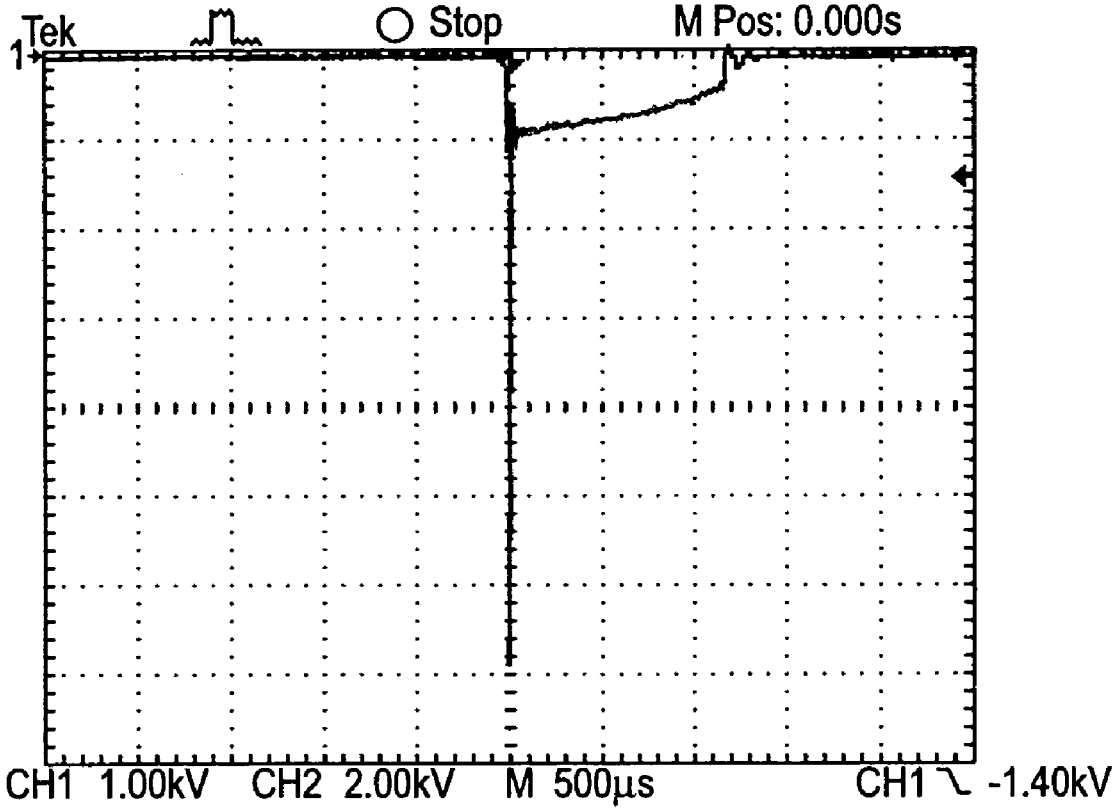

FIGS. 5–6 show examples of a variable compensation circuit 300 in accord with the present concepts used with a first diagnostic testing device and a second diagnostic testing device. FIG. 5 shows a waveform prior to inversion and subsequent to adjustment to eliminate distortion, such as that shown in FIG. 1(*c*), wherein the firing line is adjusted to about 7 kV and the best return to zero at the end of the burntime or sparkline. FIG. 5 shows a waveform resulting from combination of the variable compensation circuit 300 with a COP-1 (Ford) ignition, a spring clip capacitive adapter as a sensor, and a Snap-On® MODIS™ as a diagnostic testing device, wherein the variable compensation circuit is connected to the MODIS™ by an EETM306A01 cable. FIG. 6 shows another waveform on Channel 1, from the same COP-1 ignition, using a HV probe (Snap-On® Part No. P6015) and a TEK TDK220 diagnostic testing device. This combination of the HV probe and the TEK TDK220 is extremely accurate and represents the "gold standard" of diagnostic testing by which other devices and combinations are measured. As a result of the variable compensation circuit 300, no significant distortion is observed between the output waveforms of FIGS. 5–6.

The examples described herein may be used with any desired ignition system or engine. Those systems or engines may comprises items utilizing organically-derived fuels or fossil fuels and derivatives thereof, such as gasoline, natural gas, propane and the like or combinations thereof. Those systems or engines may be utilized with or incorporated into another systems, such as an automobile, a truck, a boat or ship, a motorcycle, a generator, an airplane and the like. Various aspects of the present concepts have been discussed in the present disclosure for illustrative purposes. It is to be understood that the concepts disclosed herein is capable of use in various other combinations and environments and is capable of changes or modifications within the scope of the concepts expressed herein. Moreover, although examples of the apparatus and method were discussed, the present concepts are not limited by the examples provided herein and additional variants are embraced by the claims appended hereto.

What is claimed is:

1. A variable compensation circuit for capacitive adapters, comprising:

an input connector for receiving a signal output from a capacitive adapter positioned within an electric near field emitted from a component of an engine ignition system;

an output connector for outputting a signal output from the variable compensation circuit;

a capacitive divider circuit portion disposed in series between the input and output connectors, the capacitive divider circuit portion comprising at least one of a variable capacitor and a plurality of fixed capacitors; and a switching element configured to enable at least one of adjustment of a variable capacitor and selection or de-selection of at least one of the plurality of fixed capacitors to provide one of a plurality of selected capacitance reactance ratios.

2. A variable compensation circuit for capacitive adapters according to claim 1, further comprising a first shunt connected in parallel to an output of the capacitive divider circuit portion at one end and connected to ground at another end.

3. A variable compensation circuit for capacitive adapters, comprising:

an input connector for receiving a signal output from a capacitive adapter positioned within an electric near field emitted from a component of an engine ignition system;

an output connector for outputting a signal output from the variable compensation circuit;

a capacitive divider circuit portion disposed in series between the input and output connectors, the capacitive divider circuit portion comprising at least one of a variable capacitor and a plurality of fixed capacitors;

a first shunt connected in parallel to an output of the capacitive divider circuit portion at one end and connected to ground at another end; and a switching element configured to enable at least one of adjustment of a variable capacitor and selection or de-selection of at least one of the plurality of fixed capacitors to provide one of a plurality of selected capacitance reactance ratios;

wherein the first shunt comprises a variable capacitor and a switching element disposed to isolate the first shunt from the capacitive divider circuit portion.

4. A variable compensation circuit for capacitive adapters according to claim 3, further comprising a second shunt connected in parallel to an output of the capacitive divider circuit portion at one end and connected to ground at another end.

5. A variable compensation circuit for capacitive adapters according to claim 4, wherein the second shunt comprises a plurality of capacitors connected in parallel and at least one switching element disposed to isolate at least a portion of the second shunt from the capacitive divider circuit portion.

6. A variable compensation circuit for capacitive adapters according to claim 5, wherein the switching element of the capacitive divider circuit portion comprises at least one of a switch, a relay, a rotary switch, an electronic switching matrix, and a multiplexer.

7. A variable compensation circuit for capacitive adapters according to claim 6, wherein the switching element of the first shunt comprises at least one of a switch, a relay, and a rotary switch, and wherein the switching element of the second shunt comprises at least one of a switch, a relay, a rotary switch, an electronic switching matrix, and a multiplexer.

8. A variable compensation circuit for capacitive adapters according to claim 7, wherein the switching element of the second shunt comprises a rotary switch adapted to permit selection of individual capacitors or groupings of capacitors.

9. A variable compensation circuit for capacitive adapters according to claim 7, wherein the capacitive divider circuit portion comprises a first capacitor having a capacitance of about 22 pF, a second capacitor having a capacitance of about 68 pF, and a variable capacitor having a capacitance of between about 8 and 50 pF, wherein the first shunt comprises a variable capacitor having a capacitance of between about 300 and 1000 pF, and wherein the second shunt comprises a first capacitor having a capacitance of about 150 pF, a second capacitor having a capacitance of about 150 pF, a third capacitor having a capacitance of about 150 pF, and a fourth capacitor having a capacitance of about 150 pF.

10. A signal compensation method for engine ignition system diagnostics testing comprising the steps of:

establishing a circuit between a capacitive sensor positioned within an electric near field emitted from a component of an engine ignition system, a variable compensation circuit, and a diagnostic testing device;

inputting a signal from the capacitive sensor to the variable compensation circuit;

monitoring the signal output from the variable compensation circuit using the diagnostic testing device; and adjusting a capacitance value of at least one capacitor in the variable compensation circuit to provide one of a plurality of selected capacitance reactance ratios, wherein the variable compensation circuit comprises a capacitive divider circuit portion including a plurality of capacitors and a switching element configured to enable at least one of a selection, de-selection, and adjustment of the plurality of capacitors.

11. A signal compensation method for engine ignition system diagnostics testing in accord with claim 10, wherein the adjusting step further comprises adjusting a capacitance value of a capacitive divider circuit portion disposed in series between an input connector and an output connector of the variable compensation circuit, the capacitive divider circuit portion comprising at least one of a variable capacitor and a plurality of fixed capacitors.

12. A signal compensation method for engine ignition system diagnostics testing comprising the steps of:

establishing a circuit between a capacitive sensor positioned within an electric near field emitted from a component of an engine ignition system, a variable compensation circuit, and a diagnostic testing device;

inputting a signal from the capacitive sensor to the variable compensation circuit;

monitoring the signal output from the variable compensation circuit using the diagnostic testing device; and adjusting a capacitance value of at least one capacitor in the variable compensation circuit to provide one of a plurality of selected capacitance reactance ratios, wherein the variable compensation circuit comprises a capacitive divider circuit portion including a plurality of capacitors and a switching element configured to enable at least one of a selection, de-selection, and adjustment of the plurality of capacitors; and the adjusting step further comprises adjusting a capacitance value of a first shunt connected in parallel to an output of the capacitive divider circuit portion at one end and connected to ground at another end, the first shunt comprising at least one of a variable capacitor and a plurality of fixed capacitors and a switching element disposed to isolate the first shunt from the capacitive divider circuit portion.

13. A signal compensation method for engine ignition system diagnostics testing, comprising the steps of:

establishing a circuit between a capacitive sensor positioned within an electric near field emitted from a component of an engine ignition system, a variable compensation circuit, and a diagnostic testing device;

inputting a signal from the capacitive sensor to the variable compensation circuit;

monitoring the signal output from the variable compensation circuit using the diagnostic testing device; and adjusting a capacitance value of at least one capacitor in the variable compensation circuit to provide one of a plurality of selected capacitance reactance ratios, wherein the variable compensation circuit comprises a capacitive divider circuit portion including a plurality of capacitors and a switching element configured to enable at least one of a selection, de-selection and adjustment of the plurality of capacitors; and the adjusting step further comprises adjusting a capacitance value of a second shunt connected in parallel to an output of the capacitive divider circuit portion at one end and connected to ground at another end, the second shunt comprising a plurality of capacitors connected in parallel and at least one switching element disposed to isolate at least a portion of the second shunt from the capacitive divider circuit portion.

14. A signal compensation method for engine ignition system diagnostics testing in accord with claim 12, wherein the adjusting step further comprises adjusting a capacitance value of at least one of the capacitive divider circuit portion and the first shunt to adjust a firing line of a displayed waveform output from the variable compensation circuit.

15. A signal compensation method for engine ignition system diagnostics testing in accord with claim 14, wherein the adjusting step further comprises adjusting a capacitance value of at least one of the capacitive divider circuit portion and the first shunt to adjust a return to zero portion of a displayed waveform output from the variable compensation circuit.

16. A signal compensation method for engine ignition system diagnostics testing, comprising the steps of:

establishing a circuit between a capacitive sensor positioned within an electric near field emitted from a component of an engine ignition system, a variable compensation circuit, and a diagnostic testing device;

inputting a signal from the capacitive sensor to the variable compensation circuit;

monitoring the signal output from the variable compensation circuit using the diagnostic testing device; and adjusting a capacitance value of at least one capacitor in the variable compensation circuit to provide one of a plurality of selected capacitance reactance ratios, wherein the variable compensation circuit comprises a capacitive divider circuit portion including a plurality of capacitors and a switching element configured to enable at least one of a selection, de-selection, and adjustment of the plurality of capacitors;

wherein the adjusting step further comprises adjusting a capacitance value of a capacitive divider circuit portion disposed in series between an input connector and an output connector of the variable compensation circuit, the capacitive divider circuit portion comprising at least one of a variable capacitor and a plurality of fixed capacitors, and wherein the adjusting step further comprises adjusting a capacitance value of a first shunt connected in parallel to an output of the capacitive divider circuit portion at one end and connected to ground at another end, the first shunt comprising at least one of a variable capacitor and a plurality of fixed capacitors and a switching element disposed to isolate the first shunt from the capacitive divider circuit portion.

17. A signal compensation method for engine ignition system diagnostics testing in accord with claim 16, wherein the adjusting step further comprises adjusting a capacitance value of a second shunt connected in parallel to an output of the capacitive divider circuit portion at one end and connected to ground at another end, the second shunt comprising a plurality of capacitors connected in parallel and at least one switching element disposed to isolate at least a portion of the second shunt from the capacitive divider circuit portion.

18. A signal compensation method for engine ignition system diagnostics testing in accord with claim 17, wherein the adjusting step further comprises adjusting a capacitance value of at least one of the capacitive divider circuit portion, first shunt, and second shunt to adjust a firing line of a displayed waveform output from the variable compensation circuit.

19. A signal compensation method for engine ignition system diagnostics testing in accord with claim 18, wherein the adjusting step further comprises adjusting a capacitance value of at least one of the capacitive divider circuit portion, first shunt, and second shunt to adjust a return to zero portion of a displayed waveform output from the variable compensation circuit.

20. A signal compensation method for engine ignition system diagnostics testing comprising the steps of:

establishing a circuit between a capacitive sensor positioned within an electric near field emitted from a component of an engine ignition system, a variable compensation circuit, and a diagnostic testing device;

inputting a signal from the capacitive sensor to the variable compensation circuit;

monitoring the signal output from the variable compensation circuit using the diagnostic testing device; and adjusting a capacitance value of at least one capacitor in the variable compensation circuit to provide one of a plurality of selected capacitance reactance ratios, wherein the variable compensation circuit comprises a capacitive divider circuit portion including a plurality of capacitors and a switching element configured to enable at least one of a selection, de-selection, and adjustment of the plurality of capacitors, and wherein the adjusting step further comprises adjusting a return to zero portion of a displayed waveform output from the variable compensation circuit.

* * * * *